United States Patent [19]

Wirth et al.

[11] 4,015,579

[45] Apr. 5, 1977

[54] SPACE HEATER

[75] Inventors: George H. Wirth, New Athens; Sherwin L. Derby, O'Fallon, both of Ill.

[73] Assignee: Autocrat Corporation, New Athens, Ill.

[22] Filed: Aug. 25, 1975

[21] Appl. No.: 607,683

[52] U.S. Cl. ..... 126/63; 126/121; 126/131

[51] Int. Cl.[2] ..... F24C 1/14

[58] Field of Search ..... 126/120, 121, 130, 131, 126/58, 62, 63, 67, 77, 90 R

[56] References Cited

UNITED STATES PATENTS

| | | | |
|---|---|---|---|
| 2,270,940 | 1/1942 | Elmore | 126/90 R |
| 2,494,527 | 1/1950 | Walters | 126/121 |
| 3,168,088 | 2/1965 | Martin et al. | 126/77 |
| 3,744,477 | 7/1973 | Andrews | 126/120 |

*Primary Examiner*—Ronald C. Capossela
*Attorney, Agent, or Firm*—Ralph W. Kalish

[57] ABSTRACT

A space heater incorporating a cabinet having a combustion chamber; there being doors for closing and opening in the front wall of the cabinet which when opened permit front loading of the cabinet for service of the latter as a conventional fire place. With said doors closed, the heater may be used for a thermostatically controlled convection type heater with there being air defining passageways within said combustion chamber for flow about and through a firebox defined by a grate and liner components disposed spacedly from the walls of said cabinet. When used as a convection type heater, introduction of air to the combustion chamber is controlled by a thermostatic element suitably connected to a draft box drawer.

20 Claims, 19 Drawing Figures

SPACE HEATER

BACKGROUND AND SUMMARY OF THE INVENTION

This invention relates in general to space heating and, more particularly, to certain, new and useful improvements in a space heater capable of operating as both a radiant heater and a convection heater.

It is an object of the present invention to provide a space heater of the character stated which is uniquely adapted to serve, optionally, in the manner of a fire place to provide a source of radiant heat or as an enclosed heating unit with outlets for heated air currents so that the surrounding space may be heated through convection.

It is another object of the present invention to provide a space heater of the type stated which is adapted for selected disposition within a space and incorporating control means for maintaining a preselected temperature.

It is another object of the present invention to provide a space heater which does not require costly modification of structural components defining the spacing for installation purposes.

It is another object of the present invention to provide a space heater which does not necessitate pretrained skill on the part of the user to adapt said heater for either of its conditions of use.

It is a still further object of the present invention to provide a space heater which may be substantially constructed of steel and cast components which are extremely durable in usage so as to obviate frequency of replacement, as well as to assure longevity of usage.

It is another object of the present invention to provide a space heater of the type stated which embodies unique air flow means for promoting efficient combustion of the utilized fuel, such as primarily wood. It is a still further object of the present invention to provide a space heater of the type stated which may be economically manufactured; which is amenable to presentation in a multiplicity of attractive exterior design motifs, such as, for instance, being reminiscent of the well known Franklin heater; and which is extremely economical in usage.

DESCRIPTION OF PRACTICAL EMBODIMENTS

Figure 2:
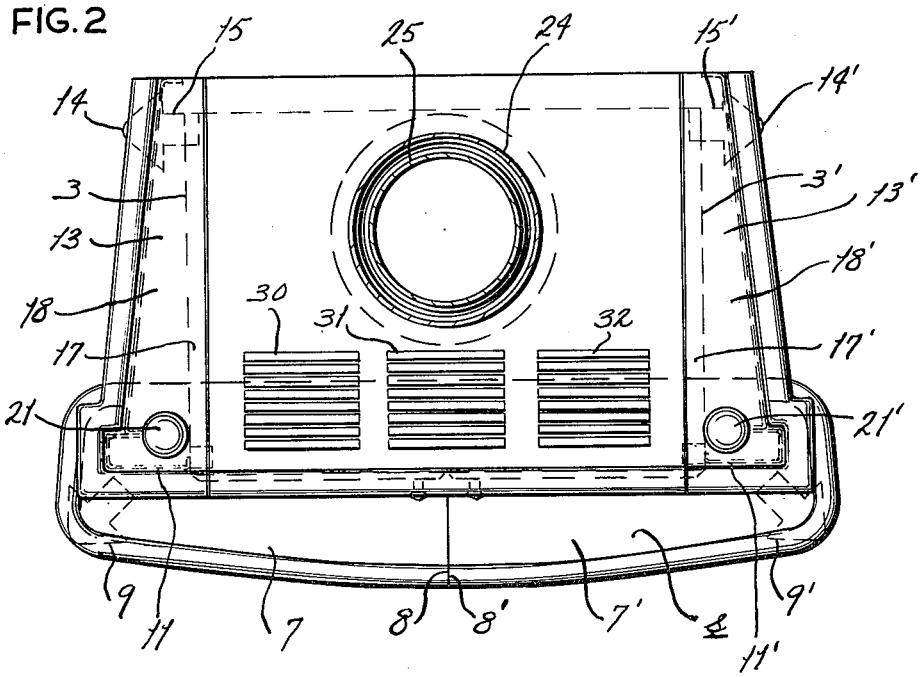
FIG. 2 is a top plan view with the flue in section.
Figure 5:
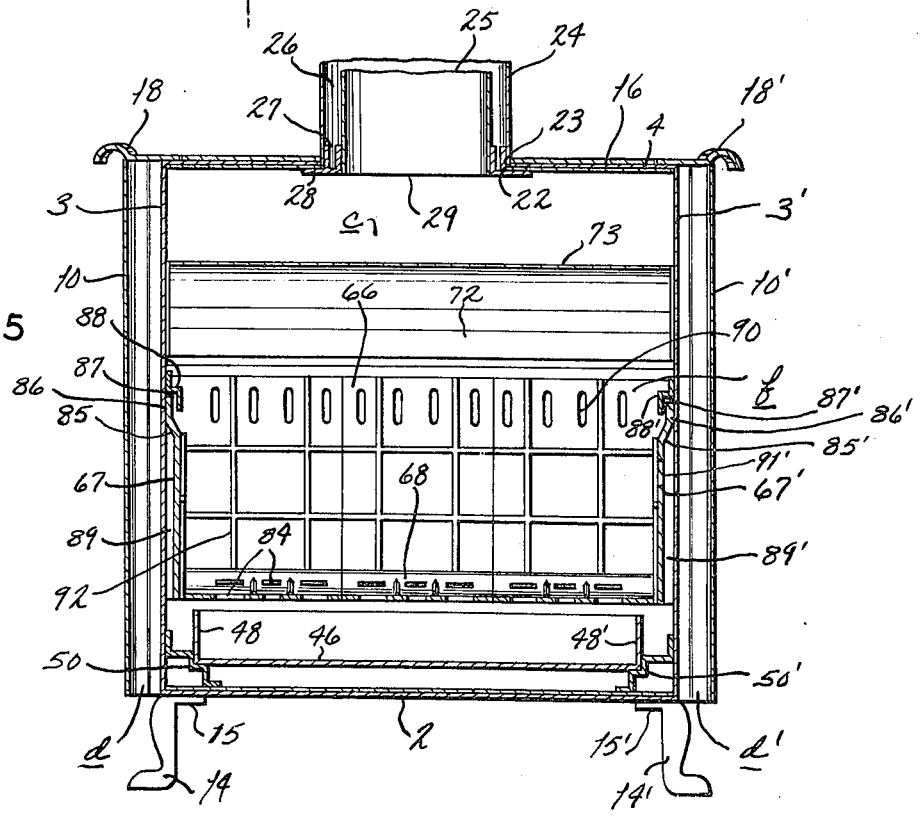
FIG. 5 is a vertical transverse sectional view taken on the line 5—5 of FIG. 3.
Figure 6:
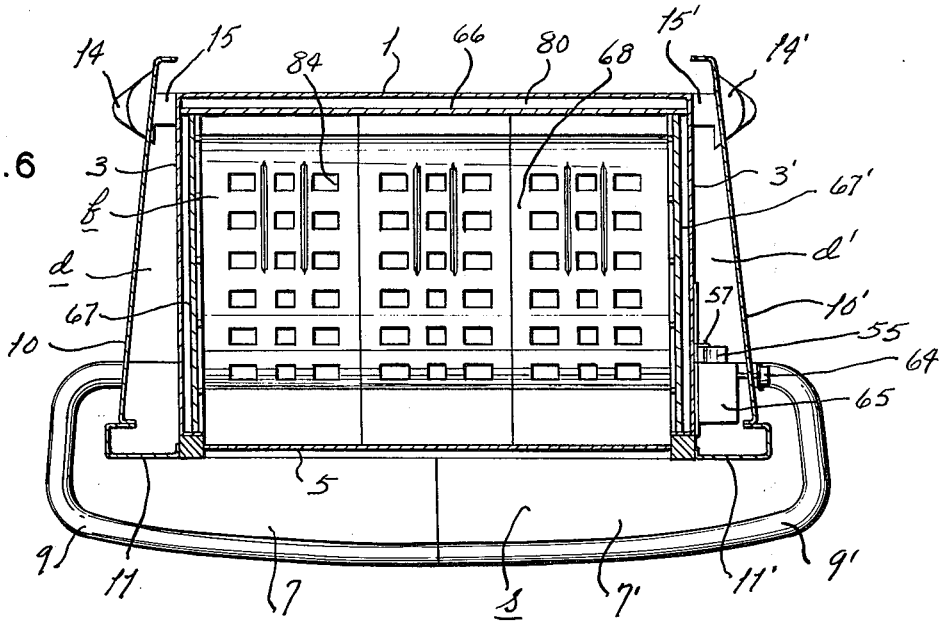
FIG. 6 is a horizontal transverse sectional view taken on the line 6—6 of FIG. 1.

Referring now by reference numerals to the drawings which illustrate practical embodiments of the present invention, A generally designates a space heater which, as will be shown more fully hereinbelow, is uniquely adapted for utilization as a free-standing fire place, as well as being capable of serving as a thermostatically controlled, wood-burning heater. Said heater A comprises a cabinet C defined by a rear wall 1, a bottom wall 2, parallel side walls 3,3', a top wall 4, and a front wall 5, which latter cooperate to interiorly present a combustion chamber *c*. Bottom wall 2 in its forward portion rests upon cooperating hearth-forming members 7,7' which are symmetrical, abutting along their inner confronting edges, as at 8,8', and extending both forwardly of cabinet C, as well as laterally outwardly of the forward side portions thereof defining a shelf-like surface *s*. At each of their ends, members 7,7' are fixed upon the upper ends of depending standards or legs 9,9', respectively, for supporting the forward portion of heater A in elevated relationship to the support surface. Disposed laterally outwardly of, and spacedly from, cabinet side walls 3,3' are outer side plates 10,10', respectively, which at their forward ends are supported upon the lateral portions of members 7,7', respectively, and which side plates 10,10' at their forward ends are rigidly fixed to front side components 11,11'. Said front components 11,11' abut on their inner edges against the confronting forward edge portions of cabinet side walls 3,3', and on their forwardly presented face may be suitably decorated, such as by fluting, at 12,12', respectively, for enhancing the aesthetic appearance of heater A. As may best be seen in FIG. 2, side plates 10,10' are rearwardly and inwardly inclined toward their rearward ends whereby the planes thereof, if extended, would intersect at a point spacedly beyond cabinet rear wall 1. It will be seen that by reason of the configuration of side plates 10,10', the intervening spacing, as at 13,13', between same and cabinet side walls 3,3' constitutes a rearward tapering volume which is open at its lower end, as at *d,d'* (see FIG. 5). In their rearward end portions outer side plates 10,10', are supported upon standards or short legs 14,14' which are thus located laterally inwardly of the related forward standards 9,9', respectively, and being of like extent therewith. Said rearward standards 14,14' are provided at their upper ends with flanges, as at 15,15', for affixation by any suitable means to overlying portion of bottom wall 2.

Provided upon top wall 4 is a plate 16 which is slightly shorter in its transverse dimensions than wall 4 so that the projecting side portions of the latter will constitute lateral shoulders, as at 17,17', upon which rests the inner side portions of top decorative elements 18,18' being preferably formed as by casting, and with their outer portions received upon the upper edges of the underlying outer side plates 10,10'. Said elements 18,18' incorporate a depending skirt, as at 19,19', along their forward and outer side portions for providing an ornamental balance with similar skirt formations, as at 20,20', provided on hearth-forming members 7,7'. Finial type elements, as at 21,21', may be presented upstandingly upon said elements 18,18' for enhancing the pleasing appearance of heater A. It will thus be seen that elements 18,18' and plate 16 constitute a top closure to the volumes developed by spacings 13,13'.

Top wall 4 and plate 16 are provided in their rearward central portions with registering openings 22,23, respectively, for extension therethrough of a flue cover 24 and a vent pipe 25 concentric with said cover 24, but of relatively reduced diameter for causing a spacing 26 between the outer face of vent pipe 25 and the inner face of cover 24. At their lower ends, cover 24 and pipe 25 are supported by a flue collar 27, as fabricated by casting, which in its outer peripheral portion is suitably engaged, as by bolting, to the under face of plate 4 for maintaining said pipe and cover in operative position and with said collar 27 incorporating an annulus 28 for enclosing the lower end of spacing 26. It will thus be seen that pipe 25 opens at its lower end, as at 29, into the upper end of combustion chamber *c*. It is, of course, understood that at their upper ends pipe 25 and cover 24 may be suitably supported by conventional means for extension through an appropriate wall or roof opening for dispersion of the combustion gases to the atmosphere.

Forwardly of flue cover 24 and provided transversely of the upper side of heater A, is a series of louvers, as at 30, 31, 32, for passage therethrough of the heated air currents for distribution to the surrounding space.

Figure 1:
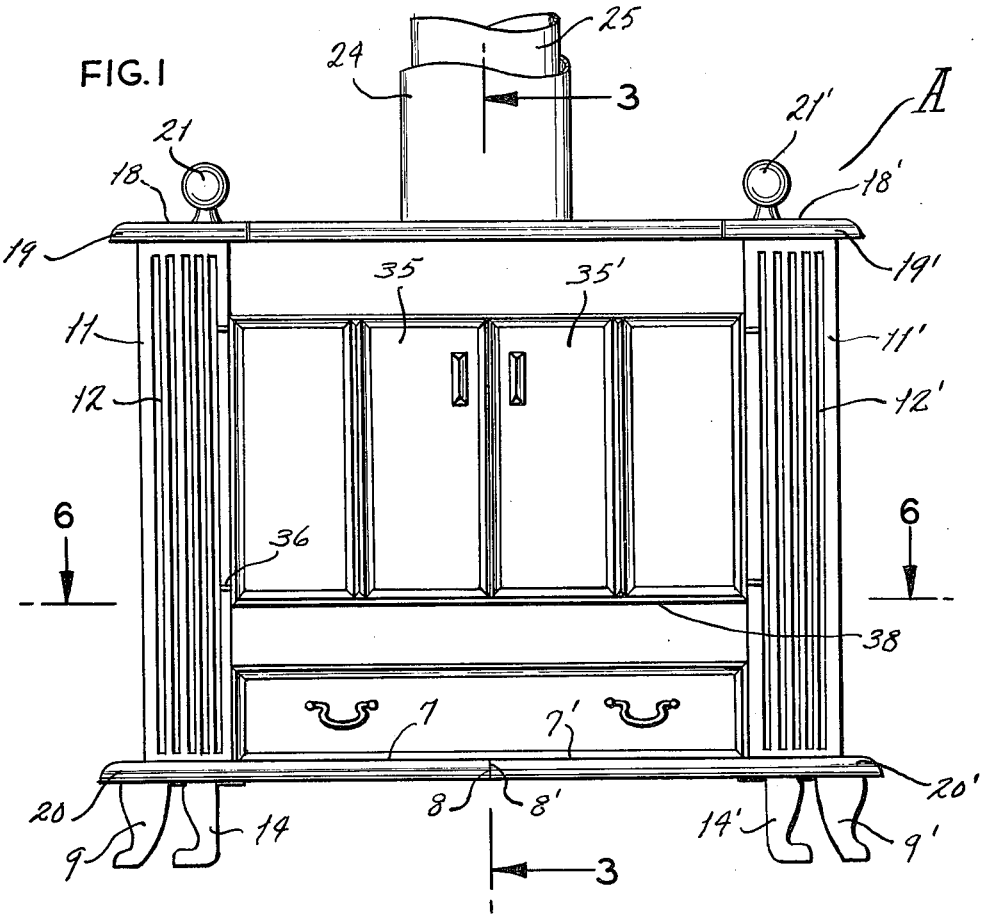
FIG. 1 is a front view of a space heater constructed in accordance with and embodying the present invention.

Front wall 5 substantially intermediate its height is provided with an enlarged transversely extending opening 33 on the margins of which is mounted a complementary door frame 34 for a pair of cooperating front closures or doors 35,35' which are preferably of symmetrical design for overlap on their inner side edges when in closed condition (see FIG. 1). Said doors 35,35' are hingedly and detachably mounted on their outer side edges as by pintles, indicated 36, formed in frame 34 whereby said doors 35,35' may swing outwardly and forwardly into open condition or rearwardly into the aforesaid closed condition. The detachability of said doors 35,35' from their hinge connections will be described more fully hereinbelow. Said frame 34 is provided with a marginal forwardly extending flange, as at 37, for cooperation with a rearwardly opening marginal recess 38 provided on doors 35,35'; which recesses are shown as being of V-shape in cross section and suitably gasketed as by asbestos rope; and by acceptance of the confronting portion of flange 37 promote relative air tightness when said doors 35,35' are in closed condition.

Figure 3:
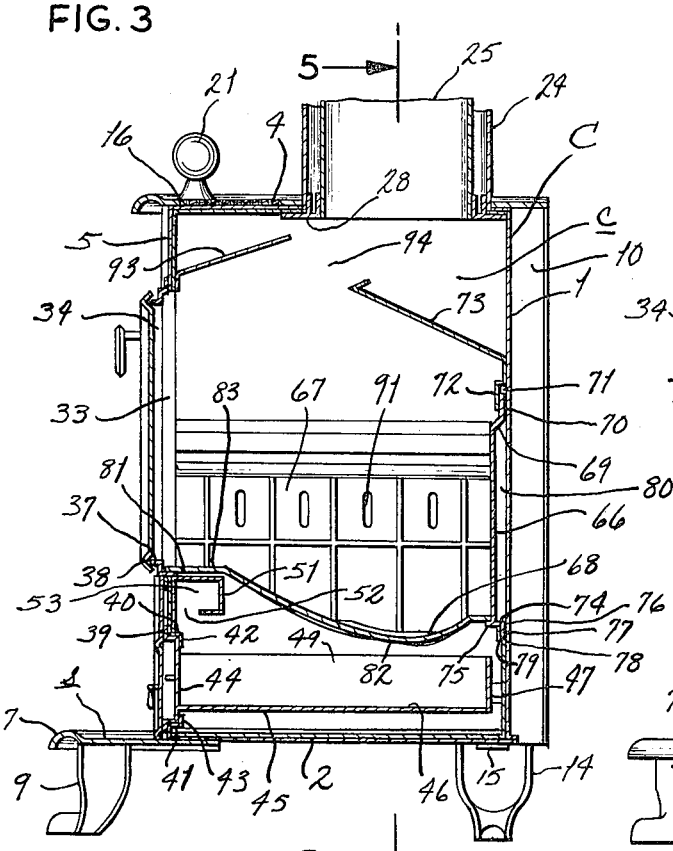
FIG. 3 is a vertical transverse sectional view taken on the line 3—3 of FIG. 1.
Figure 4:
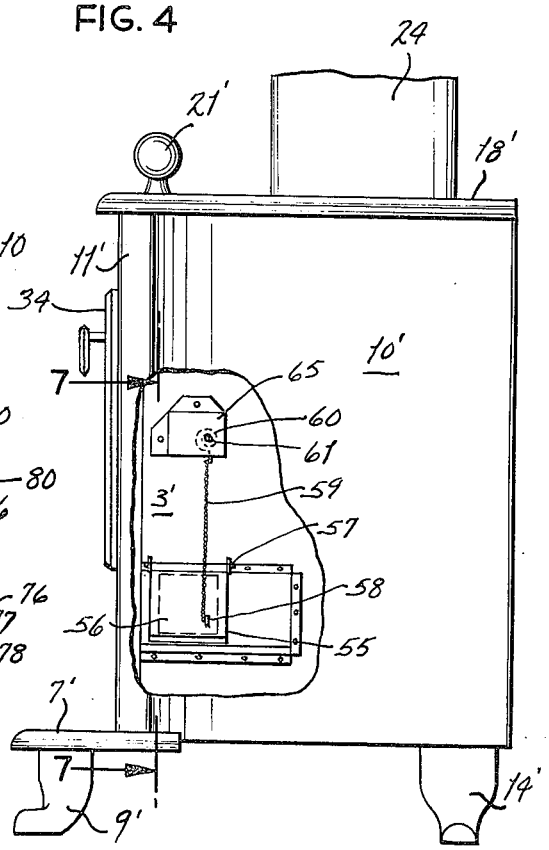
FIG. 4 is a side elevational view taken from the right-hand side of FIG. 1, but illustrating the outer side plate partially broken away.

Downwardly of opening 33, front wall 5 is provided with a lower transversely extending opening 39, the margins of which opening are turned rearwardly so as to provide upper and lower shoulders 40,41; and are thence turned upwardly, as at 42,43; to provide abutments for the forward wall 44 of an ash or residue drawer 45. Thus, shoulders 40,41 support the upper and lower edges of said drawer forward face 44 and with said portions at 42,43 serving as stops against the rearward face of said drawer forward wall 44 to inhibit rearward movement of said drawer 45. Drawer 45 is provided with a bottom wall 46, rear wall 47, side walls 48,48', and is open at its upper end, as at 49. Said drawer 45 is slideably supported on the opposed side edge portions of its bottom wall 46 by runner-forming supports 50,50' fixed on base plate 6 and the adjacent portions of side walls 3,3' (see FIGS. 3 and 5).

Figure 7:
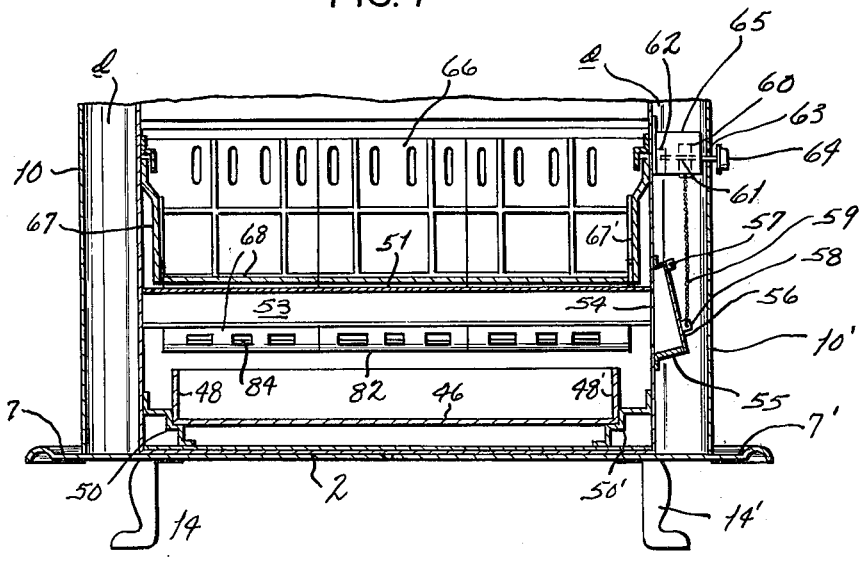
FIG. 7 is a vertical transverse sectional view taken on the line 7—7 of FIG. 4.

Rigidly fixed, as by welding, to the inner face of front wall 5 beneath the bottom portion of door frame 34 and extending transversely of said wall 5 is a duct 51 having a coextensive opening 52 in its lower portion to provide an air passage 53 which at one end terminates with side wall 3 and at its other end communicates with an opening 54 in said wall 3' with the interior of a draft box 55 disposed within spacing 13; said draft box 55 having a draft control door 56 which latter is hingedly engaged at its upper end, as at 57, for swingable movement between raised or open condition, and lower or closed condition (as shown in FIG. 7). Engaged to the outer face of draft control door 56 by means of a bracket 58 is the lower end of a chain or flexible member 59, the upper end of which is engaged to a bimetal sensor 60, or thermocouple of coil character, which is mounted upon a shaft 61 suitably journalled at its inner end by a bearing 62 mounted on the adjacent portion of wall 3' and with its outer end extending through an opening 63 in outer side plate 10'. A control knob 64 is engaged upon the outer end extremity of said shaft 61. Sensor 60 and bearing 62 are suitably encased within a box or housing 65 fixed upon side wall 3,3'. It will thus be seen that sensor 60 is exposed to the ambient atmosphere through the lower open end *d'* of spacing 13 for purposes presently appearing.

Provided within chamber *c* is a firebox, indicated *f*, uniquely comprised of a back liner 66, a pair of opposed side liners 67,67', and a grate 68. It is to be observed that each of the last-mentioned components may be integrally formed, but are preferably of multisectional character for facilitating installation, withdrawal, and replacement. For illustration only, back liner 66 and grate 68 have been shown of three-part constitution. Back liner 66, formed as by casting, is a substantially planar member extending transversely across the lower central portion of combustion chamber *c* being rearwardly bent in its upper marginal portion, as at 69, to form a spacer portion and with its edge portion thereabove projecting upwardly in substantial planar parallel relation to the principal plane of said back liner 66 to develop a tongue 70 for reception within the downwardly opening recess 71 of a bracket 72 fixed to rearward wall 1; which bracket at its upper end is integral with a forwardly and upwardly inclined smoke shelf 73 which extends transversely of chamber *c* and with its forward upper edge terminating substantially rearwardly of the upper end of door frame 34. Said recess 71 is of greater depth than the received portion of tongue 70 to allow for upward shifting of back liner 66 for purposes of removal and insertion, as will become more apparent hereinbelow. At its lower end back liner 66 is integral with a base flange 74 in planar perpendicular relationship to the principal plane of back liner 66 having a short extending portion for forming a support shoulder 75 and a rearward extension, as at 76, which contains a depending tongue 77 for full reception within a upwardly opening groove 78 provided by a bracket 79 fixed to rear wall 1. Thus, it will be seen that upon upward shifting of back liner 66 tongue 77 may be removed from groove 78 by reason of the relationship of upper tongue 70 to recess 71. It is to be also observed that rearward extension 76 of base flange 74 cooperates with spacer portion 69 to maintain the main body portion of back liner 66 spacedly from cabinet rear wall 1 to develop an air passage 80 therebetween; there being openings spacedly along flange 74.

Resting upon support shoulder 75 is the under-face of the rearward transverse margin of grate 68, the forward transverse portion of which is supported upon the inner portion of door frame 34, as at 81. It will be seen that grate 68 is contoured, from front to back, in an eccentrically dished manner with the zone of maximum depth, as at 82, being rearward of its central portion and with the under-face of said grate 68 being spacedly above ash drawer 45 except for its forward section, as at 83, which overlies duct 51. Grate 68 is provided with a multiplicity of apertures, as at 84, for air flow purposes. By reason of the contour of grate 68, wood or other combustible material disposed thereon will tend to move, through gravity, to the rear of said chamber *c* quite related to the function of a fire place basket grate.

Side liners 67,67' are of like construction and with their bottom edge portions contoured in substantial conformity to the front to back cross sectional configuration of grate 68 whereby the same in their rearward portions are supported upon the adjacent support shoulder 75 of the proximate end of back liner 66 and the forward portions of which rest upon the adjacent portions of the top surface of duct 51. In their upper top portions each side liner 67,67' is turned outwardly, inclinedly, as at 85,85' to define spacer sections and with their upper transverse extremities being in planar parallel relation to the principal plane of side liners 67,67' to define tongues 86,86' projecting into the downward opening recesses 87,87' of brackets 88,88'mounted on the inner faces of side walls 3,3', as said recesses 87, 87' are of greater depth than the received portion of tongues 86, 86', the said side liners 67,67' may be easily withdrawn from operative position by upward lifting so as to clear the bottom edges to allow for suitable manipulation. It will be seen that spacer sections 85,85' maintain side liners 67,67' respectively, spacedly inwardly of side walls 3,3' for defining therebetween air passageways 89,89'. Back liners 66 and side liners 67,67'are each provided with, throughout their extent and in their upper portion, a plurality of side-by-side openings 90, 91,91', respectively, and each also has integrally cast therein a rib formation, as of lattice character, indicated generally at 92, for reinforcing purposes and to thereby permit of the utilization of relatively reduced material.

It will accordingly be seen that air passages 80, 89, 89'are in communication and with said last-mentioned passages 89,89' being open at their bottom ends for communication with the lower end of chamber *c*.

Projecting rearwardly and upwardly from the inner face of front wall 5 immediately above door frame 34 is a smoke curtain 93 as formed of suitable sheet material which underlies louvers 30, 31, 32; the rearward upper edge of said smoke curtain terminating spacedly beneath top wall 4 proximate the lower end of flue cover 24 and being spacedly upwardly and forwardly of the leading edge of smoke shelf 73 for development of a flow passage 94 therebetween.

From the foregoing the operation of space heater A should be apparent with the same being capable, as indicated, of double purpose usage; one being as a free-standing fire place for which purpose doors 35,35' are removed from their hinges and may be stored in a convenient location, such as by hooks (not shown) provided on the rear of heater A. Logs may then be disposed upon grate 68 and ignited in the customary manner as by kindling, paper, or the like, or combustible fluids to thereby provide a source of radiant heat emanating through the front wall opening 33 which, if desired, may have a screen (not shown) disposed thereacross to prevent expulsion of sparks. Thus when so used space heater A serves the identical purpose of the conventional built-in fire place and thereby serves a space which may not have been previously provided with the customary type fire place. When used as a fire place, space heater A is easily maintained in a cleaned state since the ashes or residue from combustion will descend through apertures 84 for collection in ash box 45.

Smoke curtain 93 prevents smoke from entering the ambient space when doors 35,35' are removed, while smoke shelf 73 serves to spread the heat evenly within the combustion chamber and prevent loss of heat through vent pipe 25 and the connected chimney.

In its other condition of use, heater A serves as a thermostatically controlled wood burning heater and thus is of circulating character as distinguished from a source of radiant heat. In this manner of use, doors 35,35' are disposed in closed condition and render chamber *c* substantially air tight (the front wall 44 of drawer 45 coacting in like manner with adjacent wall components so that said chamber *c* is dependent for combustion air entering through draft box 55). Thus, by suitable adjustment of knob 64 bimetal sensor 60, or otherwise thermostat, is set so that desired temperature control may be maintained. Thus, when the temperature within combustion chamber *c* falls below the particular preselected temperature, bimetal sensor 60 will contract to cause draft control door 56 to be raised to allow for introduction of air through the lower end of *d'* of spacing 13 and into air passage 53 whence air will flow through opening 52 and through the openings 84 in grate 68 as well as upwardly within the air passageways 89,89' from which flow will enter firebox through openings 91,91' in said side liners 67,67'. Air will also flow upwardly within air passage 80 and then through openings 90 thereby constituting a requisite up-draft as well as adequate supply of oxygen for fuel burning purposes. Should the temperature within chamber *c* rise above the preselected temperature draft control door 56 will automatically close. The heated air will be distributed to the ambient space through louvers 30, 31, 32. Accordingly, space heater A thus relies upon a flow of convection heating currents for heating purposes as opposed to radiant heat when serving as a fire place. The openings 91,91' within side liners 67,67' and opening 90 within back liner 66 provides ventilation for achieving lower external temperatures conducing to longevity of usage of the components, as well as facilitating cleaning thereof. The air passages disposed between cabinet walls and the liners also are of insulating nature so that there is minimal heat transference through the walls of cabinet C and thereby conduce to maximum heat being emitted through louvers 30, 31, 32. The bevel arrangement provided by smoke curtain 93 and smoke shelf 73 prevents smoke from entering the surrounding space.

Therefore, in view of the foregoing, it will be observed that heater A is a nevel construction, being capable of serving a duality of functions with production of maximum heat.

Referring now to FIGS. 8–13, inclusive, A′ designates another form of space heater constructed in accordance with the present invention, having various components in common with space heater A above described, which common components will bear like reference numerals.

Heater A′ comprises an outer casing constituted of a rear plate 111 which in its side portions is fixed to the adjacent edges flanges of side plates 10,10′, the planes of which are rearwardly and inwardly inclined toward their rearward ends so as to be in mutually diverging relationship forwardly. At their forward ends side plates 10,10′ are rigidly fixed to front side components 11,11′, respectively. At their forward lower ends, side plates 10,10′ are supported upon members 7,7′, the latter resting upon legs 9,9′, and on their rearward ends are supported upon standards 14,14′. Disposed within said outer casing is a cabinet C defined by a rear wall 1, bottom wall 2, parallel side walls 3,3′, a top wall 4, and a front wall 112, defining combustion chamber *c*. Cabinet C is supported by legs 9,9′ and standards 14,14′ by reason of bottom wall 2 being engaged to the latter and disposed on its forward portion upon members 7,7′. As may best be seen in FIGS. 10, 11, and 12, cabinet side walls 3,3′ are disposed inwardly of side plates 10,10, respecitvely, to develop intervening spacings, as at 13,13′, constituting a volume open at its lower end, as at *d,d′*, respectively.

Similarly, rear wall 1 is disposed spacedly forwardly of rear plate 111 for establishing a volume 113 therebetween which is open at its lowe end, as at *e*.

Figure 9:
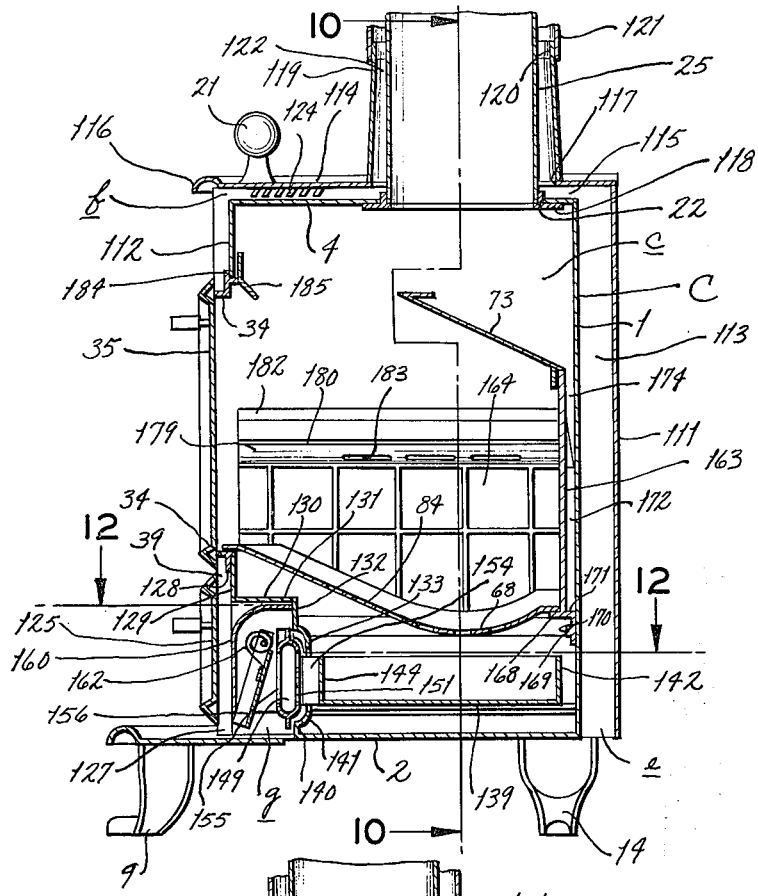
FIG. 9 is a vertical transverse sectional view taken on the line 9—9 of FIG. 8.
Figure 10:
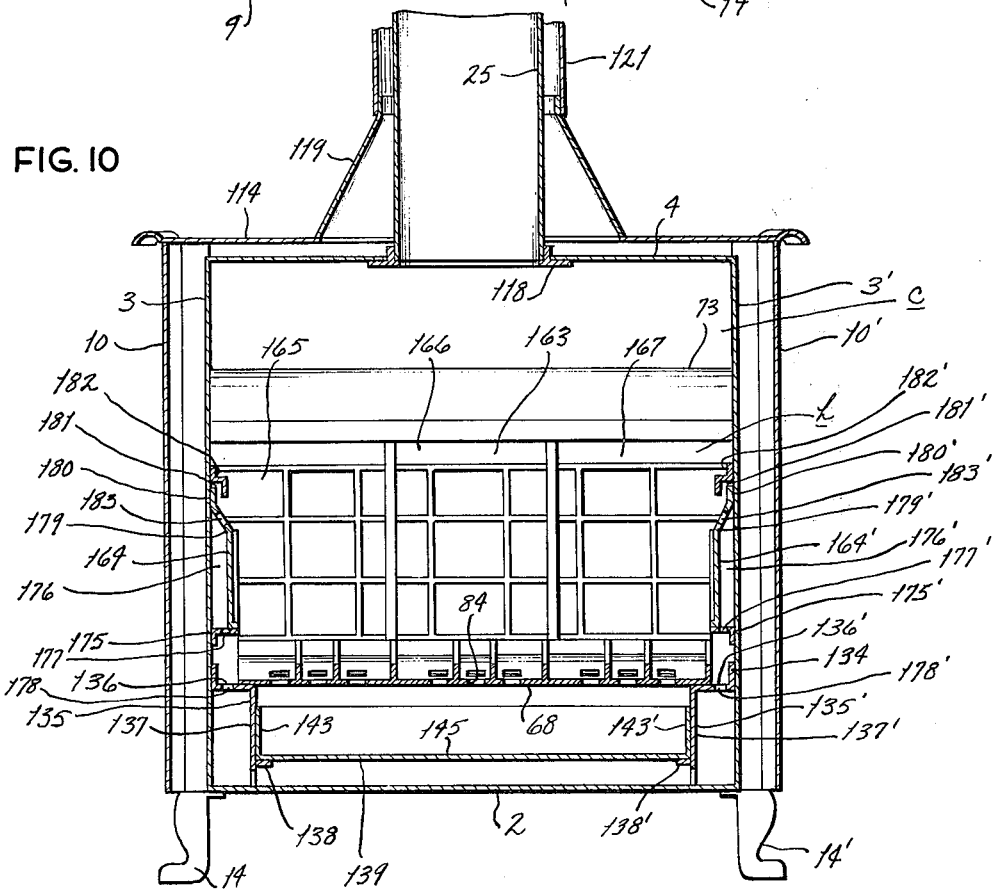
FIG. 10 is a vertical transverse sectional view taken on the line 10—10 of FIG. 9.
Figure 11:
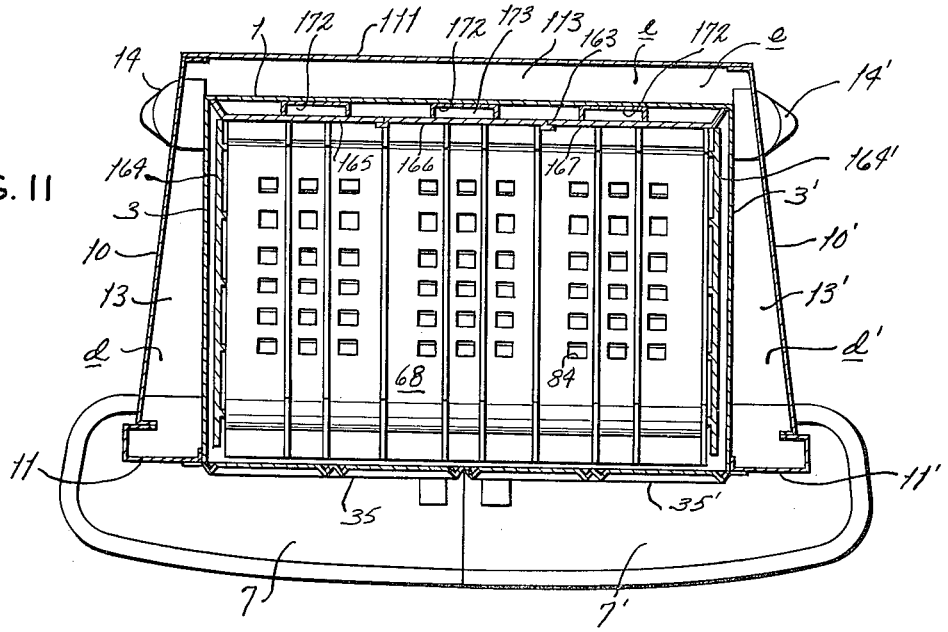
FIG. 11 is a horizontal transverse sectional view taken on the line 11—11 of FIG. 8.
Figure 12:
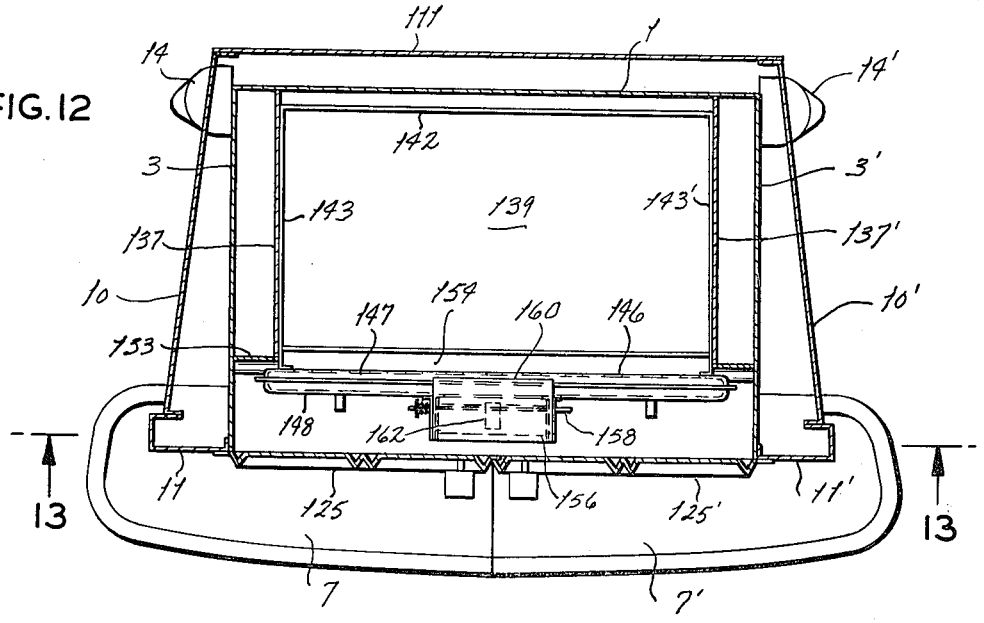
FIG. 12 is a horizontal transverse sectional view taken on the line 12—12 of FIG. 9.
Figure 13:
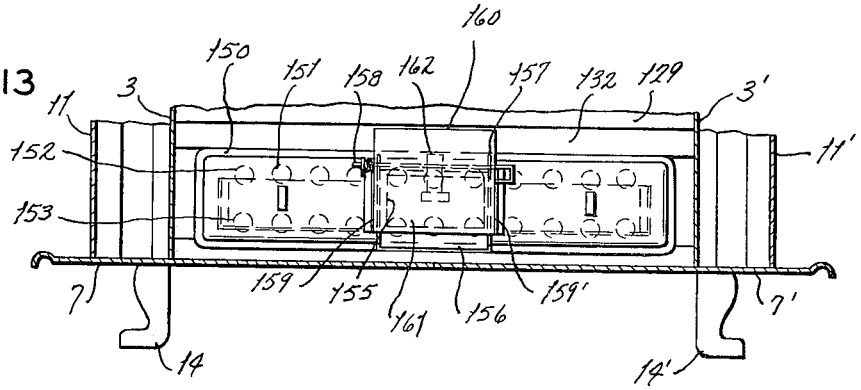
FIG. 13 is a vertical transverse sectional view taken on the line 13—13 of FIG. 12.
Figure 14:
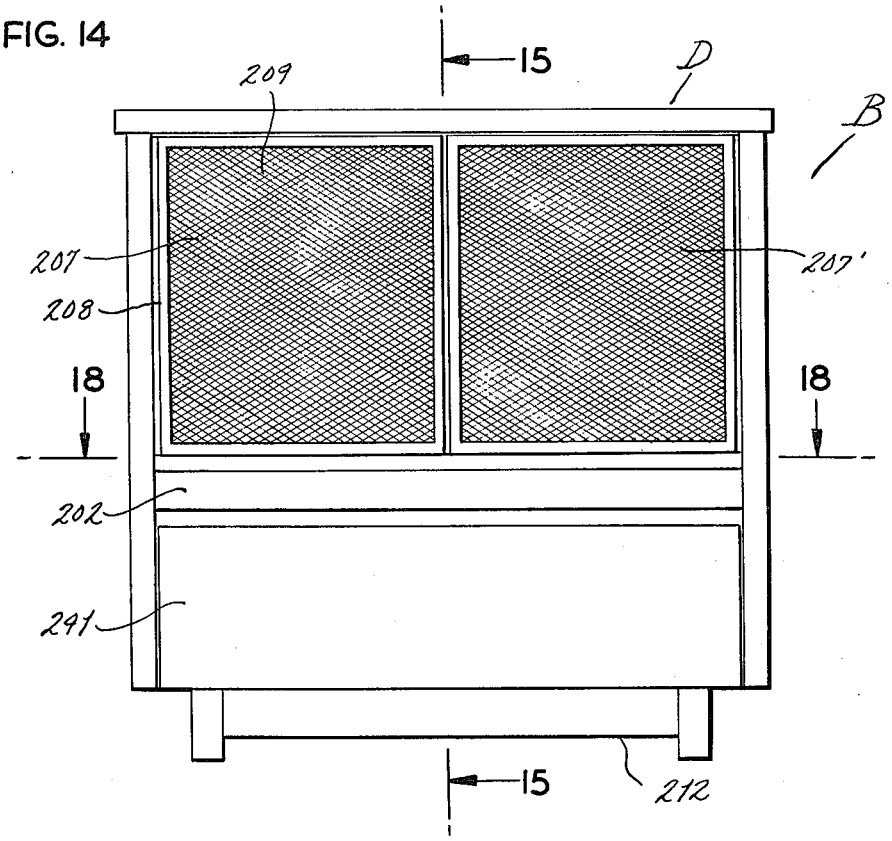
FIG. 14 is a front view of a further form of space heater constructed in accordance with and embodying the present invention.

Rear plate 111 and side plates 13,13′ project above cabinet C and support upon their upper edges a top closure plate 114 located spacedly above top wall 4 to define therewith a volume 115 therebetween which communicates with volumes 113, 13, and 13′ (see FIGS. 9 and 10). As may best be seen in FIG. 9, volume 115 is open at its forward end, as at *f*, to the space to be heated for reasons presently appearing. Top closure plate 114 in its lateral portions projects beyond outer plates 10,10′ and forwardly beyond front side components 11,11′ and being marginally downwardly concave, or constituting a depending skirt, as at 116, for finishing purposes.

Top wall 4 and top closure plate 114 are provided in their rearward central portions with axially aligned openings 22, 117, respectively, the latter being of relatively increased cross section and being of general eliptical contour. Secured as by bolting, to the underface of top wall 4, is a flue collar 118, fabricated as by casting, which supports, at its lower end, vent pipe 25. Fixed suitably to the margins of opening 117 is the lower end of a short sleeve 119 of eliptical form in cross section, but inwardly and upwardly tapering, having a constant diametral upper end portion, as at 120, for engagement on its outer surface, as by welding, bolting, etc., to the lower end of a flue cover 121 which, at its upper end, terminates spacedly from the upper end of pipe 25. It will be seen by reference to FIGS. 8, 9, and 10 that sleeve 119 and flue cover 121 are disposed encirclingly of vent pipe 25 and spacedly therefrom to effect development of an air passage 122 therebetween which at its lower end communicates with volume 115. Flue cover 121 in its upper end portion is provided with a series of air ports 123 in grid formation for outflow of air therethrough as will be shown more fully below. The upper end of flue cover 121 is provided with an inturned flange (not shown) to effect a top closure to passage 122 to assure that air will be discharged through ports 123. Provided transversely of chamber top wall 4 is a series of louvers 124 arranged forwardly of sleeve 119. Front wall 112 is provided with an upper pair of front closures or doors 35,35′ which are mounted and interrelated in the same manner as above described in conjunction with space heater A.

Downwardly of doors 35,35′, front wall 112 in its opening 39 is provided with a second or lower pair of front closures or doors 125,125′ which are vertically aligned with doos 35,35′ being of similar formation or character for like interrelationship and being similarly hingedly and detachably mounted on their outer side edges, as by pintles 126.

As may be seen in FIG. 9, the lower edges of doors 125, 125′ terminate spacedly upwardly from the underlying portions of members 7,7′ to develop an air passage 127 therebetween.

The bottom portion of door frame 34 contains a short downwardly extending flange 128 to the rear face of which is fixed the upper edge portion of the vertical flange 129 of a mounting bracket 130 which includes a rearwardly turned, horizontal section 131 at the lower end of said flange 129; said bracket 130 extending transversely of heater A between side walls 3,3′. At its rearward end horizontal section 131 is continuous with a short depending flange 132 which latter at its lower end is continuous with a short curvate terminal portion 133 for purposes presently appearing. With reference to FIG. 9 it will be seen that bracket 130 is so related to the underlying portion of members 7,7′ and the adjacent portions of side walls 3,3′ so as to cooperate with same to create a volume *g* immediately inwardly of doors 125,125′ being accessible through opening of said doors. Secured, as by welding or the like, to opposed inner face portions of side walls 3,3′ in their lower portions and immediately rearwardly of the terminals 133 of bracket 130 are the upper end flanges 134 of drawer mounts 135 which include short inwardly extending horizontal sections 136,136′ and depending wall sections 137,137′ which terminate at their bottom edges spacedly from bottom wall 2. On their confronting sides, wall sections 137,137′ are provided with inwardly directed short shoulders 138,138′ which constitute runners for a drawer 139 serving as an ash pan. Shoulders 138,138′ at their rearward end edges, together with the rearward end edges of drawer mounts 135,135′ are rigidly attached to rear wall 1. It will thus be seen that terminal 133 of bracket 130 is so spaced from bottom wall 2 to permit drawer 139 to travel reciprocally therebeneath. Aligned with bracket terminal 133 is a co-ordinating member 140 which is fixed on its lower edge to bottom wall 2 and contains in its upper portion a curvate terminals 141 complementary to terminal 133 of bracket 130. Said co-ordinating member 140 being fixed in its upper portion to the forward ends of shoulders 138,138′ so that drawer 139 may move thereacross. Drawer 139 is constituted of a rear wall 142, parallel side walls 143,143′, a front wall 144, and a bottom wall 145 supported upon said shoulders 138,138' as above described. Said drawer side walls 143,143' extend forwardly of front wall 144 for rigid securement to the opposite end portions of the rearward face of the rear wall 146 of an air duct 147 having a front wall 148 aligned with, and spaced forwardly of, said rear wall 146 to develop an air passage 149 therebetween. Said duct 147 is closed at its upper and lower ends and sides by the said walls 146,148 being cooperatively rounded or curvate for merging into a peripheral stop flange 150. With reference to FIG. 9, it will be seen that the angle of curvature of the rounded portions of rear wall 146 are complementary to the angles of curvature of bracket terminals 133 and co-ordinating member terminal 141. Rear wall 146 of duct 147 is provided througout its extent with a series of outlets 151 which, by way of example only, may be arranged in upper and lower rows, as at 152,153, for communicating with the spacing 154 between said duct rear wall 146 and drawer front wall 144. Front wall 148 of duct 147 in its central portion is provided with a single, relatively enlarged, inlet opening 155 which may be of any suitable edge configuration, such as, by way of example only, rectangular. Provided for closurewise relationship with respect to opening 155 is a draft control door 156 swingably suspended, by means of brackets 157, from a transversely extending rod 158, the ends of which are rigidly fixed in the side walls 159,159' of a housing member 160 which is rigidly secured along the rearward edges of its side walls 159,159' to the front wall 148 of duct 147, and having a front wall 161 which extends downwardly, spacedly forwardly of front wall 148 of duct 147 within volume *g* and terminating at its lower end spacedly above the underlying portion of bottom wall 2. It will be seen by reference to FIG. 9 that the spacing between housing front wall 161 and the confronting portion of duct 147 is adequate to permit swinging of draft control door 156 between duct-open (FIG. 9) and duct-closed condition. Engaged upon rod 158 in its central portion is a bi-metal sensor 162, or thermocouple of coil character, having an end portion fixed to draft control door 156. It will be seen that sensor 162 is exposed to the ambient through air passage 127 for purposes presently appearing. Also, it will be appreciated that drawer 139, air duct 147, housing 160, and sensor 162 constitute an integrated unit easily movable from heater A' upon opening of doors 125,125' for inspection, removal of ashes, and the like, and for reciprocal restitution to operative condition.

Provided within chamber *c* is a firebox *h* comprised of a back liner 163, a pair of opposed side liners 164,164', and a grate 68. Back liner 163 may, if desired, be of multi-part constitution and is shown herein as having three-co-ordinating sections 165, 166, 167. Back liner 163 extends transversely across the lower central portion of combustion chamber *c* and being uniplanar throughout its vertical extent having a base flange 168 at its lower end with a depending tongue 169 at its rearwardy end for engagement within a loop-forming bracket 170 fixed to rear wall 1. Said back liner 163 is located spacedly forwardly of said rear wall 1; the base flange 168 having a rearwardly projecting portion 171 serving as a spacer, as well as a support for upstanding ducts 172 which at their lower ends are aligned with openings 173 provided in said base flange 168 and which ducts communicate at their upper ends with the upper portion of combustion chamber *c* via the spacing, as at 174, between back liner 163 and rear wall 1. Resting upon the forward portion of back liner base flange 168 is the underface of the rearward transverse margin of grate 68, side edge portions of which rest upon horizontal sections 136,136' (FIG. 10) and the forward transverse edge portion of which rests upon the bottom of door frame 34 (FIG. 9).

Side liners 164,154' are of like construction, being supported at their lower ends upon angle brackets 175,175' secured to the inner face of side walls 3,3', respectively. The principal portions of side liners 164,164' are planarwise parallel and inwardly spaced from the adjacent side wall 3,3' to provide air passages 176,176', respectively; the lower ends of said latter open through a series of apertures 177,177', respectively, in angle brackets 175,175' which series of apertures 177,177' register with openings 178,178' also arranged in series form in horizontal sections 136,136', respectively. Each of said side liners 164,164' is laterally outwardly bent in its upper marginal portion as at 179,179' to form a spacer and with its edge portion thereabove projecting upwardly in substantial planar parallel relation to the principal plane of the related side liner 164,164' to develop a tongue 180,180' for reception within a downwardly opening recess 181,181' of a bracket 182,182', respectively, fixed to the proximate side wall 3,3'. Formed within each laterally outwardly bent portion 179,179' is a multiplicity of ports 183,183'respectively, forming a path of communication between air passages 176,176' respectively, and the upper portion of combustion chamber *c.* Supported, as by a bracket 184, from the inner face of wall 112 above door frame 34, is a relatively short downwardly and rearwardly inclined smoke screen 185.

From the foregoing it is evident that space heater A' functions in a different manner than space heater A. Space heater A' by reason of its novel construction provides a duality of paths of travel for air flow. One such path of travel directs air into combustion chamber *c* for heating, as by the particular fuel burning on grate 68, and with the heated air being directed through vent pipe 25. The other path of travel directs air from the space being treated about combustion chamber *c* for warming as by radiation or heat transfer through the walls of said chamber *c* and thence upwardly through air passage 122 for return to the ambient space by way of air ports 123.

Accordingly, it will be observed that air from the environment which has been previously heated will be directed to air passage 122 surrounding vent pipe 25 by flow upwardly through volumes 13,13' and 113 and thence into volume 115 for flow upwardly through flue cover 121. As pointed out above, such heated air may also enter air passage 122 by entry into volume 115 from the forward open side thereof, as at *f.* Thus, air following the path just described will be warmed from the combustion occurring within combustion chamber *c* and thence be returned for space heating purposes by out-flow through grid air ports 123.

The other path, as indicated, is for purpose of providing requisite air to support combustion within chamber *c.* Accordingly, air will travel through air passage 127, thence through duct inlet opening 155 for flow along said duct 147 and emission rearwardly through outlets 151 in duct rear wall 146 from which the air moves from spacing 154 through openings 84 in grate 68, as well as upwardly through air channels 172. Concurrently, air may also move upwardly through openings 178,178' then through apertures 177,177', respectively, through air passages 176,176' and then through ports 183,183' whereby adequate air is provided for combustion. Draft control door 156 is thus responsive to operation of sensor 162 so that when the ambient temperature falls below a prescribed level, the said sensor will contract and thereby cause door 156 to swing the open position, as shown in FIG. 9, to permit provision of air for combustion. Conversely, when the ambient temperature has reached a prescribed level, sensor 162 will expand permitting door 156 to return to duct-closed condition.

Thus, space heater A' is of unique construction to permit of discrete air flow paths to assure of efficient and requisite heating of the immediate environment.

Referring now to FIGS. 14–19, inclusive, B designates another form of space heater constructed in accordance with the present invention, having various components in common with space heaters A,A' above described, which common components may bear like reference numerals.

Heater B comprises an outer casing D constituted of a rear plate 200, parallel side plates 201,201', a front plate 202, and a bottom plate 203; there being a top closure 204 which latter is of double walled character having an intervening layer of suitable insulation material, as at 205. As may easily be seen from the FIGURES, rear plate 200 terminates spacedly above the rearwardly projecting portion of bottom plate 203 for defining therewith and the adjacent edges of side plates 201,201' and enlarged opening 206 for air circulation purposes, as will be shown more fully hereinbelow. Front wall 202 in its upper portion is provided with a pair of swingably mounted complementary door closures 207,207', each of which embody frames 208 for retaining a screen or mesh panel 209 conducive to air flow therethrough. Said panels 209 may be easily removed in their entirety, if desired, but as indicated, are hingedly mounted for outward swinging to permit access to the interior of casing D for purposes presently appearing.

Figure 8:
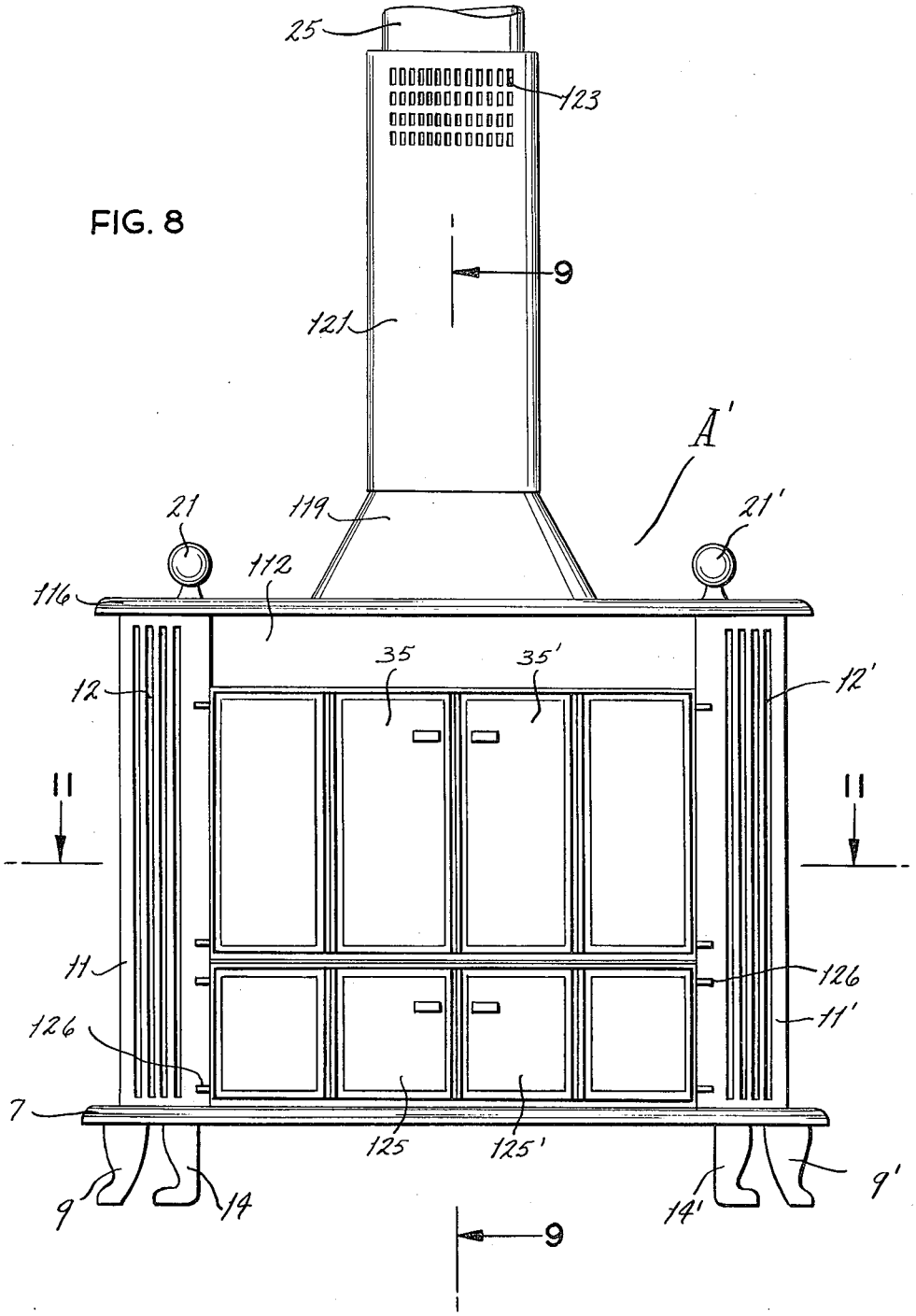
FIG. 8 is a front view of another form of space heater constructed in accordance with and embodying the present invention.

Each side plate 201,201' in its upper end portion immediately beneath top closure 204 is provided with a substantially coextensive opening 210,210' for purposes more evident hereinbelow. As shown in FIG. 8, casing D may incorporate corner constructions for receiving rigidifying vertical elements as indicated broadly at 211. Casing D may be mounted upon any suitable support but is shown herein as engaged upon a generally pedestal-type mount 212 of reduced cross section with respect to bottom plate 203.

Disposed within outer casing D is a cabinet E defined by a rear wall 213, a base wall 214 (said latter being disposed upon bottom plate 203), side walls 215,215', a top wall 216, and a front wall 217. Rear wall 213 in its upper portion is provided with an opening 218 for receiving a stepped fitting or collar 219 for a vent pipe 220 which progresses rearwardly through an aligned opening 221 in outer casing rear plate 200 along an axis perpendicular to the vertical axis of heater B as for extension through a wall (not shown) of the volume being served by heater B.

Figure 15:
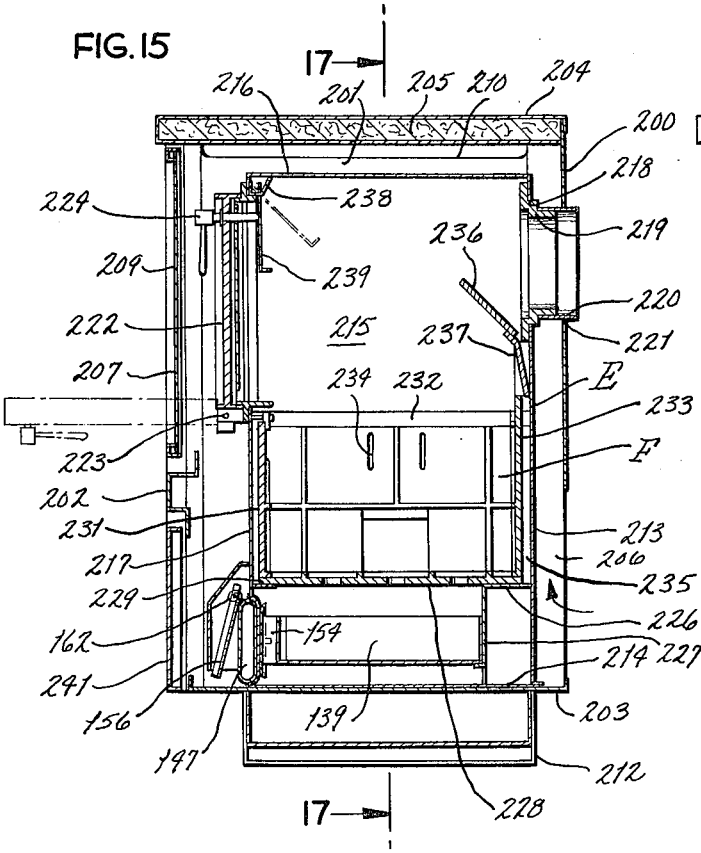
FIG. 15 is a vertical transverse sectional view taken on the line 15—15 of FIG. 14.
Figure 16:
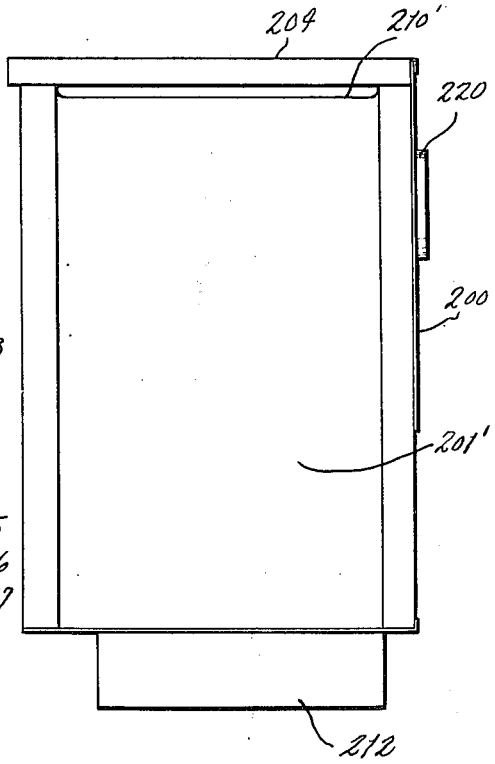
FIG. 16 is a side elevational view taken on the right hand side of FIG. 14.

Front wall 217 in its upper portion inwardly and rearwardly of outer casing top closure 207 is provided with a closure 222 hingedly mounted at its lower end, as at 223, upon a suitable mounting for vertical swinging movement between downwardly, heater open condition (shown in phantom lines in FIG. 15), and heater-closed condition (shown in full lines in FIG. 15). Said closure 222 is provided with a rotatably mounted latching arm 224.

Of particular importance is the fact that the walls of cabinet E are located spacedly inwardly of the corresponding, confronting plates of outer casing D. Thus, top wall 216 is presented downwardly of closure 204; rear wall 213 is is spacedly forwardly of rear plate 200; front wall 217 is rearwardly of frong plate 202 and side walls 215,215' are laterally inwardly of side plates 201,201', respectively, for thereby creating a continuous circulation zone, as broadly indicated a *z*, between said cabinet E and outer casing D which, as will be shown, permits of heat transfer to ambient atmosphere entering said zone *z* such as through opening 206, as indicated by an arrow in FIG. 15.

In its lower portion, cabinet E is suitably provided with planarwise aligned side and rear shelf-like supports 225, 225', 226 as maintained by vertical plates 227 to form a rest for a firebox F; said latter incorporating a flat, base-forming grate 228 disposed upon said supports 225,225',226 as well as upon a short, planarwise aligned flange 229 extending inwardly from front wall 217. Said grate 228 is provided with a multiplicity of apertures 230 for air flow purposes. Upstanding from each edge portion of grate 228 is a liner, such as a front liner 231, a pair of side liners 232,232', and a rear liner 233, which are basically of like construction to the liners described hereinabove with space heaters A and A' and having, expectedly, openings 234 in their upper portions.

Figure 17:
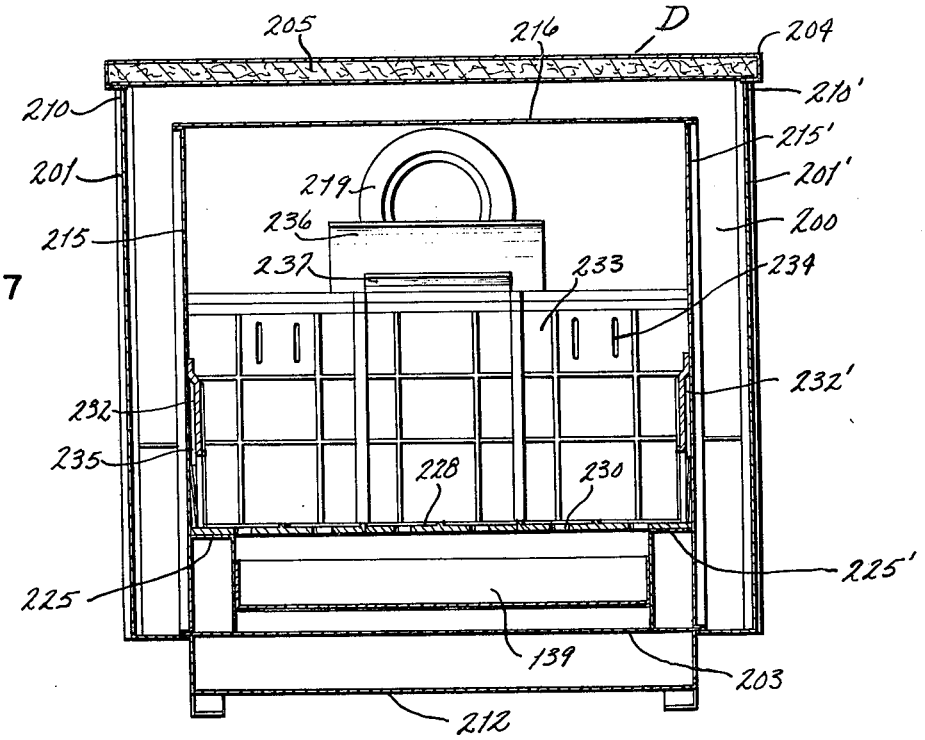
FIG. 17 is a vertical transverse sectional view taken on the line 17—17 of FIG. 16.
Figure 18:
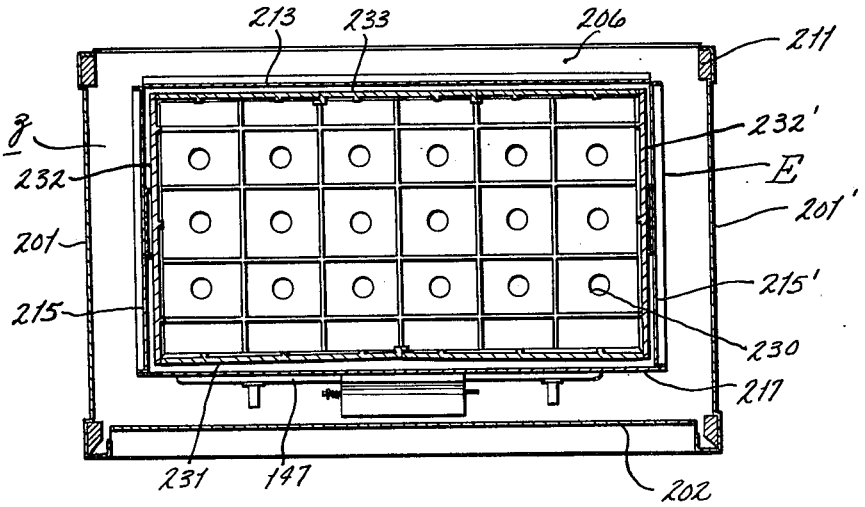
FIG. 18 is a horizontal transverse sectional view taken on the line 18—18 of FIG. 14.

With particular reference to FIG. 15, as well as FIGS. 17 and 18, it will be seen that the liners of firebox B are located slightly inwardly of the adjacent wall of cabinet E for developing therebetween a circulating air passage, broadly indicated at 235. It will be noted that front liner 231 and side liners 232,232' terminate in proximate alignment with the lower end of closure 222 so that when thelatter is in open condition, firebox F will be located downwardly thereof and with the spacing above said firebox F providing the upper portion of the combustion chamber which incorporates firebox F. Within the upper portion of the combustion chamber is a smoke shelf 236 which projects upwardly and forwardly from the upper portion of rear liner 233 through the medium of an intervening support element 237 and with said smoke shelf 236 being located across the inner end of vent pipe 220 thereby constituting a baffle productive of wider circulation of the heater air within the combustion chamber prior to emission through vent pipe 220. Immediately inwardly of closure latch 224 when in upper closed condition, there depends from a bracket 238 a relatively short smoke curtain 239; said bracket being suitably affixed to top wall 216.

Located downwardly of grate 228 is an ash pan drawer 139 mounted on runners (not shown) in the manner of the structure involved in heater A' having an air duct 147 with an intervening spacing 154 and with said air duct 147 being controlled by a bimetal sensor 162 carried upon a draft control door 156 all of the same being of like construction as the corresponding components of heater A' above described. Beneath front wall 202 there is provided a lower front panel 241 which in normal usage will obscure air duct 147, drawer 139, sensor 162, and related structure. However, said panel 241 is adapted by conventional means for simple removal to permit of access to the interior of the lower portion of cabinet E to allow for withdrawal and reinsertion of drawer 139.

Figure 19:
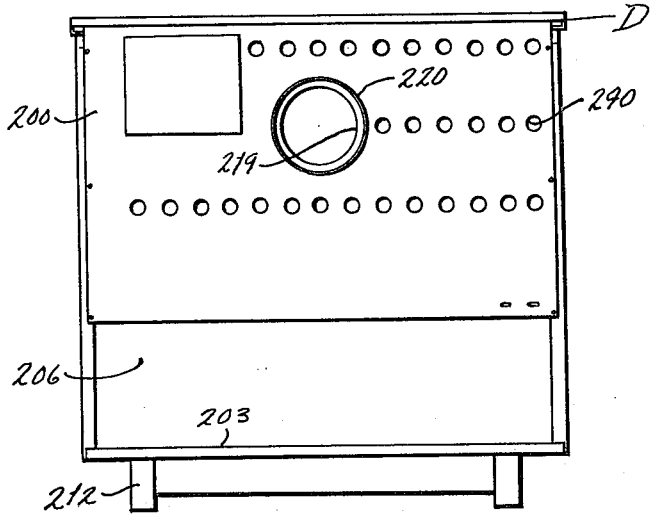
FIG. 19 is a rear elevational view.

From the foregoing the operation of heater B should become apparent since with combustion taking place within the combustion chamber incorporating firebox F, suitable heat transfer is effected through the walls of cabinet E for warming the ambient air travelling within zone z and being dispersed to the surrounding spacing through the mesh panels 209, the lateral side openings 210, 210' as well as through a multiplicity of apertures 240 provided in relative profusion in rear plate 200 of outer casing D (see FIG. 19).

Thus, heater B is a compact unit capable of generating relatively elevated temperatures and being so designed as to permit of efficient heat transfer to the surrounding volume; and with the recognition that by operating of sensor 162, door 156 may be readily opened for maintenance of the temperature at a desired level.

Having described our invention, what we claim and desire to obtain by Letters Patent is:

1. A space heater comprising a cabinet having a rear wall, a base wall, a front wall, parallel side walls, and a top wall, said walls internally defining a combustion chamber, said front wall having a first opening, closure means provided in said first opening optionally permitting access to said combustion chamber therethrough, a pair of laterally spaced apart, upstanding side liners provided in said combustion chamber inwardly of the adjacent cabinet side walls, an upstanding back liner extending between said side liners at the rearward ends thereof and being spaced forwardly of said rear wall, said side liners and said back liner terminating at their upper ends spacedly below said cabinet top wall, a fuel-supporting, apertured grate provided spacedly upwardly of said cabinet bottom wall and cooperating with said side liners and back liner to define a firebox, the spacing between said side liners and back liner and the adjacent cabinet walls defining air passages, said air passages being closed at their upper ends in the upper end portion of said side liners and back liners, said side liners and back liner having openings through which said firebox and said air passages communicate, exhaust means projecting upwardly of said cabinet top wall and communicating with said combustion chamber and said firebox, and means for introducing air into said cabinet beneath said grate for flow upwardly through the apertures thereof and into said air passages.

2. A space heater as defined in claim 1 and further characterized by said air passages being closed in the upper ends thereof by said side liners and said back liner having outwardly turned upper end portions engaging the adjacent cabinet walls to occlude said air passages defined therebetween, said air passages communicating at their lower ends with the lower portion of the cabinet beneath said grate.

3. A space heater as defined in claim 2 and further characterized by said side liners and back liner each having a plurality of openings in their upper portions establishing an air inlet into the firebox above said grate for creating an updraft therein.

4. A space heater as defined in claim 3 and further characterized by the openings in said side liners and back liner constituting a plurality of such openings arranged in spaced apart relationship throughout the extent of the associated liner.

5. A space heater as defined in claim 1 and further characterized by temperature responsive means associated with said means for introducing air to control admission of the same to the heater.

6. A space heater as defined in claim 1 and further characterized by said means for introducing air comprising said cabinet having an air ingress communicating with the ambient atmosphere, an air distributor provided within said cabinet below at least a portion of said apertured grate, said air distributor extending transversely of said cabinet and being in communication with said air ingress to receive admitted air therefrom, said air distributor having an air discharge below said grate whereby air emitted by said distributor will flow upwardly through said grate and into said firebox for combustion purposes.

7. A space heater as defined in claim 1 and further characterized by said means for introducing air comprising an air duct-forming means provided beneath said grate and extending transversely of said heater, a closure provided in the forwardly presented portion of said duct, temperature responsive means operatively engaged to said closure for controlling admission of air to said duct, said duct having a multiplicity of air discharge ports on its rearwardly presented face, said ports opening below said apertured grate.

8. A space heater as defined in claim 7 and further characterized by said cabinet front wall having a second opening located downwardly of said first opening, said second opening permitting access below said firebox, an ash receptacle provided within said cabinet beneath said grate, said air duct being engaged to said ash receptacle and constituting the forward end thereof, means slideably mounting said ash receptacle and air duct for movement outwardly through and returningly inwardly through said second opening, the air ports in said duct opening into the interior of said receptacle and flowing therefrom upwardly through said apertured grate.

9. A space heater as defined in claim 1 and further characterized by louvers provided in said chamber top wall adjacent said exhaust means for emission of warm air currents therethrough.

10. A space heater as defined in claim 1 and further characterized by said cabinet front wall having a second opening located downwardly of said first opening, ash receptacle means provided within said cabinet spacedly beneath said grate, and means slideably mounting said receptacle menas for movement outwardly through said second opening.

11. A space heater as defined in claim 10 and further characterized by said ash receptacle means being a drawer.

12. A space heater as defined in claim 1 and further characterized by casing means provided about said cabinet and comprising a rear plate, side plates, and a top plate spacedly presented from the corresponding walls of said cabinet to develop a continuous air circulating volume, said volume being open to the ambient air at its lower end, and air conduit forming means provided about said exhaust means communicating with said volume.

13. A space heater as defined in claim 12 and further characterized by said casing rear plate being of relatively reduced vertical extent whereby its lower margin is spaced upwardly of the lower end of said heater to define an enlarged port opening into said air circulating volume.

14. A space heater as defined in claim 13 and further characterized by said casing rear plate having a multiplicity of apertures formed therein for conducing to air circulation for heat transfer between the ambient atmosphere and the heat within the combustion chamber.

15. A space heater as defined in claim 12 and further characterized by the volume between said top plate and said cabinet top wall being open at its forward end for flow therethrough of air from the surrounding space.

16. A space heater as defined in claim 15 and further characterized by said exhaust means comprising a flue engaged to the cabinet top wall and projecting upwardly therefrom, and a flue cover engaged to said top plate surroundingly of, and spaced from, said flue for developing said air conduit means therebetween.

17. A space heater as defined in claim 1 and further characterized by said combustion chamber also having an upstanding front liner extending between said side liners at their forward ends.

18. A space heater as defined in claim 17 and further characterized by said grate being planarwise perpendicular to the major portions of said front, side, and rear liners causing said firebox to define an open top box.

19. A space heater as defined in claim 18 and further characterized by said heater having an outer casing with a top insulated closure, the said combustion chamber having a top wall spacedly downwardly from said insulated top closure for defining an air passage therebetween, the planes of said combustion chamber top wall and said grate being parallel, and closure means provided in said combustion chamber between said top wall and said front liner.

20. A space heater as defined in claim 19 and further characterized by exhaust means being provided in the rear wall of said combustion chamber in opposed relationship to said closure means.

* * * * *